United States Patent [19]

Harada et al.

[11] Patent Number: 5,071,266

[45] Date of Patent: Dec. 10, 1991

[54] HEAD ENGAGEMENT MECHANISM FOR THERMAL RECORDING APPARATUS

[75] Inventors: Michiya Harada, Yamatokoriyama; Ryoichi Kawai, Nara; Junichiro Matsumoto, Osaka, all of Japan

[73] Assignee: Sharp Kabushiki Kaisha, Osaka, Japan

[21] Appl. No.: 464,603

[22] Filed: Jan. 12, 1990

Related U.S. Application Data

[63] Continuation of Ser. No. 248,912, Sep. 26, 1988, abandoned.

[30] Foreign Application Priority Data

Sep. 29, 1987 [JP] Japan ..... 62-148573[U]
Sep. 29, 1987 [JP] Japan ..... 62-148574[U]

[51] Int. Cl.[5] ..... B41J 2/315
[52] U.S. Cl. ..... 400/120; 346/76 PH
[58] Field of Search ..... 400/57, 120, 356, 120 HE; 346/76 PH

[56] References Cited

U.S. PATENT DOCUMENTS

| | | | |
|---|---|---|---|
| 3,935,936 | 2/1976 | Wilczewski | 400/57 X |
| 4,563,692 | 1/1986 | Negita et al. | 400/120 |
| 4,575,733 | 3/1986 | Hattori et al. | 400/120 X |
| 4,595,936 | 6/1986 | Nakajima et al. | 400/120 X |
| 4,609,299 | 9/1986 | Hattori et al. | 400/120 X |
| 4,611,936 | 9/1986 | Yasui | 400/120 |

FOREIGN PATENT DOCUMENTS

| | | | |
|---|---|---|---|
| 216394 | 4/1987 | European Pat. Off. | 400/636.1 |
| 0216394 | 4/1987 | Fed. Rep. of Germany | 400/120 |
| 9443 | 1/1977 | Japan | 400/120 |
| 130372 | 10/1981 | Japan | 400/120 |
| 151081 | 8/1985 | Japan | 400/120 |
| 217187 | 10/1985 | Japan | 400/120 |
| 149387 | 7/1986 | Japan | 400/120 |
| 172769 | 8/1986 | Japan | 400/120 |
| 277480 | 12/1986 | Japan | 400/120 |
| 46672 | 2/1987 | Japan | 400/120 |
| 149470 | 7/1987 | Japan | 400/120 |

*Primary Examiner*—David A. Wiecking

[57] ABSTRACT

A head driving mechanism for driving a recording head for a recording apparatus, includes a cylindrical head slide shaft, a head carriage formed with a circular bore so as to be slidably and rotatably fitted, at the circular bore, around the head slide shaft. A prismatic cam shaft which is engageable with the head carriage is also provided for rotating the head carriage, and an elastic member and a solenoid are provided for urging the cam shaft in opposite directions. Upon energization of the solenoid, the cam shaft is rotated in a direction such that the recording head is selectively depressed against a platen by a driving force of the solenoid and upon de-energization of the solenoid the cam shaft is rotated by an urging force of the elastic member such that the recording head is disengaged from the platen.

5 Claims, 4 Drawing Sheets

HEAD ENGAGEMENT MECHANISM FOR THERMAL RECORDING APPARATUS

This application is a continuation of application Ser. No. 07/248,912 filed on Sept. 26, 1988, now abandoned.

BACKGROUND OF THE INVENTION

The present invention relates to a head driving mechanism for displacing a serial print type recording head towards and away from a platen in a recording apparatus such as a facsimile apparatus, a printer or the like.

FIG. 1 shows a prior art serial print type thermal printer. The known thermal printer includes a thermal head 1, a head carriage 2 having the thermal head 1 secured thereto, a head slide shaft 4, an operating lever 5, an electromagnetic solenoid 6 having a plunger 7 and a platen 8. The head slide shaft 4 is formed with an axially extending projection 3 having a raillike shape. The head carriage 2 is slidably fitted around the head slide shaft 4 so as to be moved in a printing direction of an arrow a. The head carriage 2 is engaged with the head slide shaft 4 through the projection 3 so as to be rotated together with the head slide shaft 4. Meanwhile, the operating lever 5 is pivotally provided at one end of the head slide shaft 4. The plunger 7 of the electromagnetic solenoid 6 is attached to the operating lever 5 so as to pivot the operating lever 5. By retraction of the plunger 7 upon energization of the electromagnetic solenoid 6, the head carriage 2 is rotated through the head slide shaft 4 in a direction of an arrow b for spacing the thermal head 1 away from the platen 8.

On the other hand, a coiled spring 9 for urging the operating lever 5 to rotate in a direction of an arrow c opposite to the direction of the arrow b is attached to the operating lever 5. During de-energization of the electromagnetic solenoid 6, the head carriage 2 is rotated in the direction of the arrow c by an urging force of the coiled spring 9 through the head slide shaft 4 such that the thermal head 1 is pressed against the platen 8 through a recording paper 10, whereby thermal recording is performed on the recording paper 10 by heat generated by the thermal head 1. Meanwhile, a mechanism for displacing the thermal head 1 in the printing direction of the arrow a along the head slide shaft 4 is provided and includes a driving pulley 11, a driven pulley 12, a belt 13 wound around the driving pulley 11 and the driven pulley 12 and a stepping motor 14 coupled with the driving pulley 11 such that a portion of the belt 13 is attached to the head carriage 2. By feeding of the belt 13 upon intermittent drive of the stepping motor 14, the head carriage 2 is intermittently displaced in the printing direction of the arrow a, so that thermal recording is performed on the recording paper 10 by heat generating drive of the thermal head 1 which is held in pressing contact with the recording paper 10 through the head slide shaft 4 by the urging force of the coiled spring 9. Subsequently, when the thermal head 1 has reached a stroke end in the printing direction of the arrow a, the electromagnetic solenoid 6 is energized. Therefore, the plunger 7 is retracted against the urging force of the coiled spring 9 and thus, the thermal head 1 is disengaged from the platen 8. In this disengagement state in which the thermal head 1 is disengaged from the platen 8, the head carriage 2 is returned to a print start position through reverse rotation of the stepping motor 14.

However, the known head driving mechanism has the following serious drawbacks. Namely, since it is so arranged that an engagement operation of pressing the thermal head 1 against the platen 8 and a disengagement operation of disengaging the thermal head 1 from the platen 8 are performed by rotation of the head slide shaft 4, not only the head slide shaft 4 is required to be formed with the projection 3 but the head carriage 2 is required to be formed with an engageable slot for slidably receiving the projection 3. In order to not only slide the head carriage 2 smoothly but rotate the head carriage 2 without play, the head slide shaft 4 and the head carriage 2 having the above described complicated shapes are required to be machined with high dimensional accuracy and thus, machining cost of the head slide shaft 4 and the head carriage 2 rises, thereby resulting in increased manufacturing cost of the known head driving mechanism.

Meanwhile, since it is so arranged that the head slide shaft 4 for sliding the head carriage 2 is rotated, a rotational force for rotating the head slide shaft 4 is necessarily applied to an end portion of the head slide shaft 4 by the operating lever 5. As a result, a pressing force applied from the thermal head 1 to the recording paper 10 changes according to position of the head carriage 2 relative to the head slide shaft 4 and thus, printing quality is aggravated due to nonuniform printing pressure.

SUMMARY OF THE INVENTION

Accordingly, an essential object of the present invention is to eliminate the above described disadvantages inherent in conventional head driving mechanisms, and to provide a head driving mechanism for a recording apparatus, in which components for displacing a recording head towards and away from a platen have simple shapes so as to be machined at low cost.

Another important object of the present invention is to provide a head driving mechanism of the above described type in which an urging member directly urges a head carriage itself towards the platen so as to depress the recording head against the platen at a constant pressing force at all times regardless of travel position of the head carriage.

In order to accomplish these objects of the present invention, a head driving mechanism embodying the present invention for driving a recording head for a recording apparatus so as to perform an engagement operation of depressing said recording head against a platen through a recording paper and a disengagement operation of disengaging said recording head from said platen, comprises: a head slide shaft which has a cylindrical shape such that said recording head is displaced in a printing direction extending along said head slide shaft; a head carriage which has said recording head secured thereto and is formed with a circular bore so as to be slidably and rotatably fitted, at said circular bore, around said head slide shaft; said head carriage being formed with a lever projecting therefrom; a cam shaft which has a prismatic shape and is provided in parallel with said head slide shaft; said lever of said head carriage being brought into engagement with said cam shaft such that said head carriage is rotated upon rotation of said cam shaft; an elastic member for urging said cam shaft to rotate in a first direction; and a solenoid which, upon energization thereof, rotates said cam shaft in a second direction opposite to the first direction; wherein one of flat side faces of said cam shaft and one of angular corners of said cam shaft are caused to selectively confront said lever of said head carriage by a driving force of said solenoid and an urging force of said elastic member applied during de-energization of said solenoid such that the engagement operation and the disengagement operation are performed.

By the above described arrangement of the head driving mechanism, at the time of recording of the recording apparatus, the solenoid is, for example, energized, so that the cam shaft is rotated against the urging force of the elastic member by the driving force of the solenoid and the one flat side face of the cam shaft confronts the lever of the head carriage so as to be spaced away from the lever of the head carriage. Therefore, the head carriage itself, which is rotatably mounted on the head slide shaft, can be urged to rotate by an urging member such as a coiled spring. The head carriage is rotated by the coiled spring in the direction for depressing the recording head against the platen such that the recording head is depressed against the platen through the recording paper. At this time, since not only the recording head is depressed against the platen by the urging force of the coiled spring but the coiled spring is displaced together with the head carriage, a force for depressing the recording head against the platen becomes constant at all times. Subsequently, when the recording head has reached a stroke end in the printing direction, the solenoid is de-energized, so that the cam shaft is rotated by the restoring force of the elastic member and thus, the lever of the head carriage is pushed upwardly by the one angular corner of the cam shaft. Hence, the head carriage is rotated in the direction for disengaging the recording head from the platen, so that the disengagement operation is performed. In this state, the recording head is returned to a print start position. Since the head slide shaft merely slides and rotates the head carriage thereon and a rotational force is not required to be applied to the head slide shaft, the head slide shaft can be formed into a cylindrical shape, thus resulting in reduction of machining cost of the head slide shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These objects and features of the present invention will become apparent from the following description taken in conjunction with the preferred embodiments thereof with reference to the accompanying drawings which are given by way of illustration only, and thus are not limitative of the present invention, and in which.

Before the description of the present invention proceeds, it is to be noted that like parts are designated by like reference numerals throughout several views of the accompanying drawings.

DETAILED DESCRIPTION OF THE INVENTION

Figure 1:
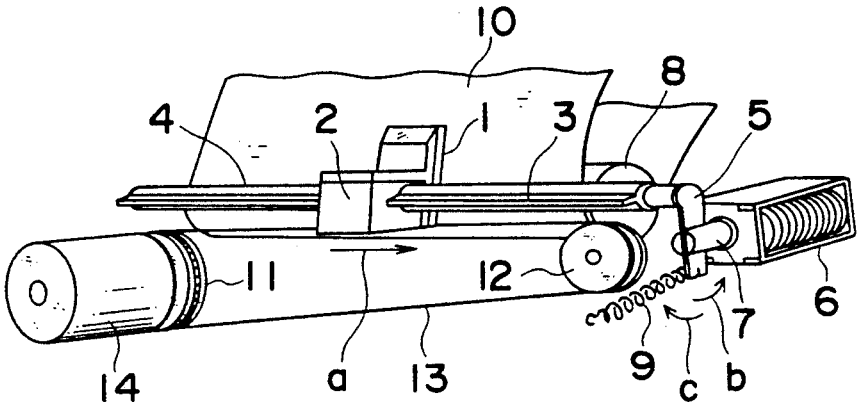
Fig. 1 PRIOR ART
FIG. 1 is a perspective view of a prior art head driving mechanism (already referred to)
Figure 2:
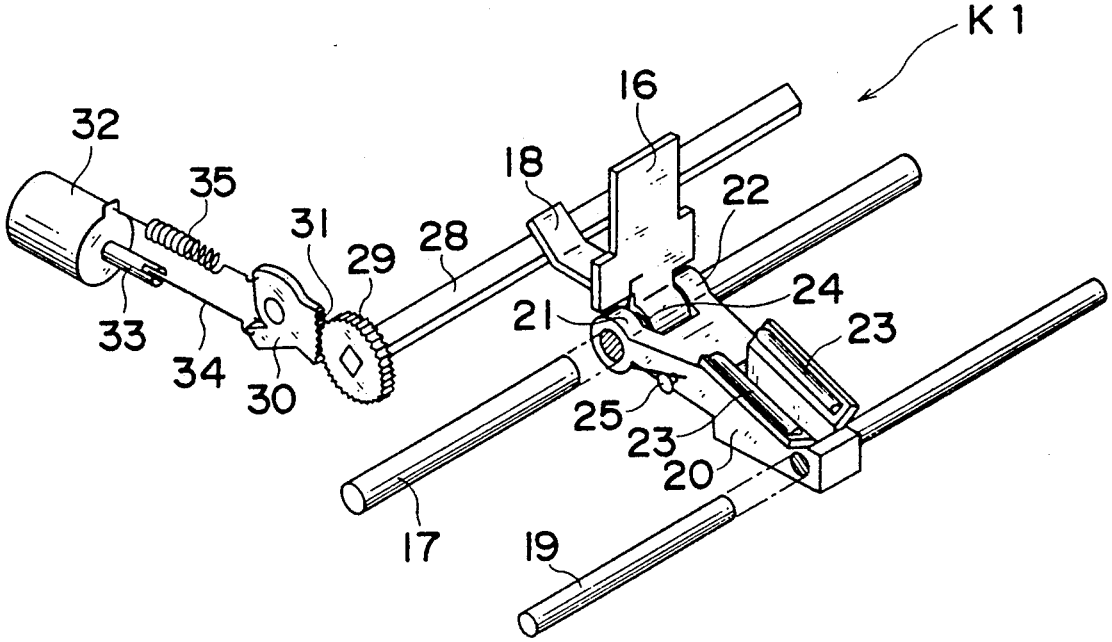
FIG. 2 is a perspective view of a head driving mechanism according to a first embodiment of the present invention, which is applied to a facsimile apparatus.
Figure 3:
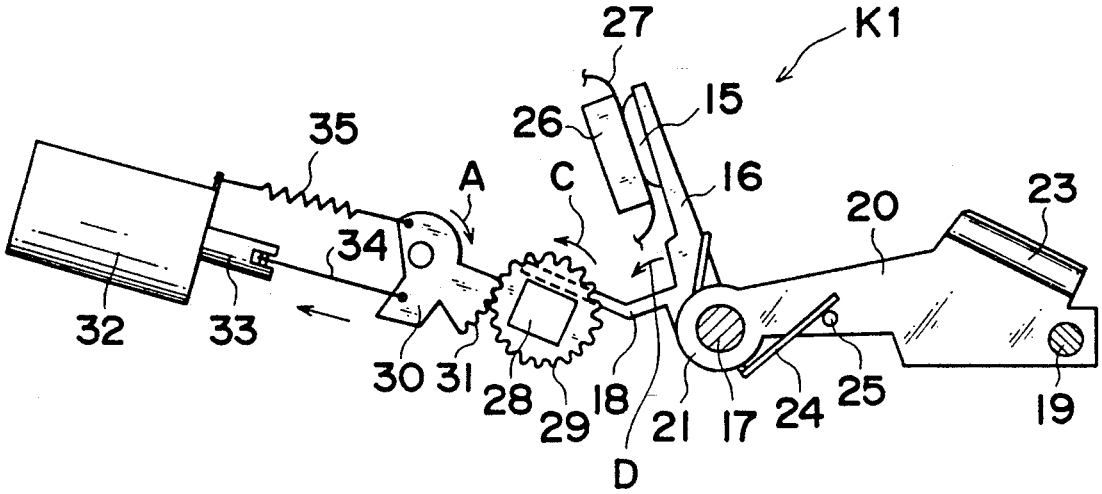
FIG. 3 is a side elevational view of the head driving mechanism of FIG. 2 at the time of recording.
Figure 4:
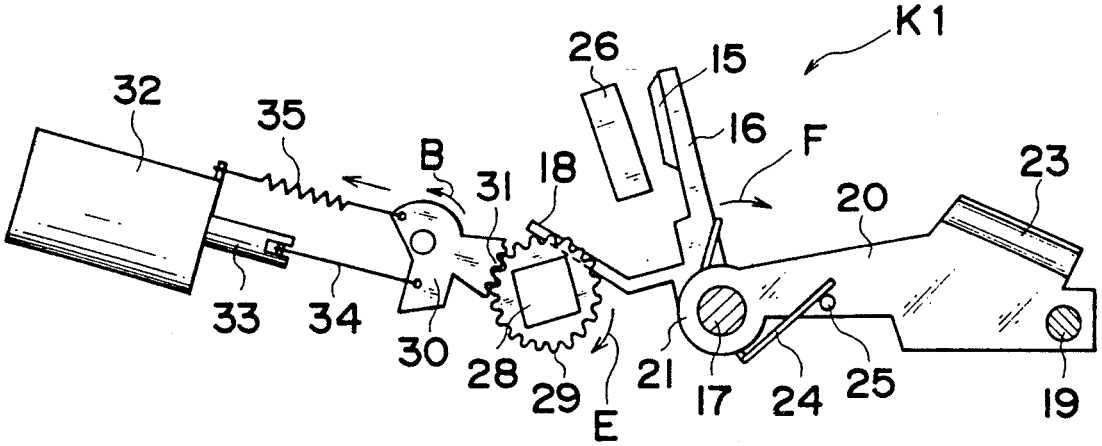
FIG. 4 is a side elevational view of the head driving mechanism of FIG. 2 at the time of return of a recording head or waiting for reception.
Figure 5:
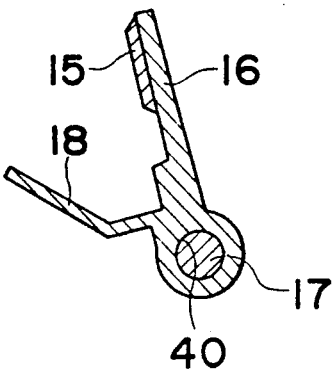
FIG. 5 is a fragmentary sectional view of the head driving mechanism of FIG. 2.

Referring now to the drawings, there is shown in FIGS. 2 to 5, a head driving mechanism K1 according to a first embodiment of the present invention, which is applied to a facsimile apparatus including a serial print type printing mechanism. The head driving mechanism K1 includes a recording head 15 constituted by a thermal head, a head carriage 16 having the recording head 15 secured thereto, a cylindrical head slide shaft 17, a scanner slide shaft 19 and a scanner carriage 20. The head carriage 16 is formed with a circular bore 40 as shown in FIG. 5 so as to be slidably and rotatably fitted, at the circular bore 40, around the head slide shaft 17. A lever 18 is integrally formed with the head carriage 16 so as to project perpendicularly to a printing direction extending along the head slide shaft 17. The scanner slide shaft 19 is disposed at one side of the head slide shaft 17 so as to extend in parallel with the head slide shaft 17. One end portion of the scanner carriage 20 is slidably fitted around the scanner slide shaft 19. The scanner carriage 20 is formed, at the other end portion, with a pair of arms 21 and 22. The other end portion of the scanner carriage 20 is slidably fitted around the head slide shaft 17 such that the head carriage 16 is gripped between the arms 21 and 22. When the scanner carriage 20 is slid on the head slide shaft 17 and the scanner slide shaft 19, the head carriage 16 is also displaced together with the scanner carriage 20 by the arms 21 and 22.

Meanwhile, the scanner carriage 20 includes a scanner constituted by a pair of LED light sources 23 for optically reading an original document (not shown), etc. such that the original document is scanned through displacement of the scanner carriage 20. A coiled spring 24 is wound around the head slide shaft 17 so as to be interposed between the arm 21 and the head carriage 16. One end of the coiled spring 24 is attached to a setting pin 25 of the scanner carriage 20, while the other end of the coiled spring 24 is attached to the head carriage 16. Thus, the coiled spring 24 urges the head carriage 16 in such a direction that the recording head 15 is depressed against a plate platen 26 through a recording paper 27. Since the coiled spring 24 is interposed between the head carriage 16 and the arm 21 as described above, the coiled spring 24 is displaced together with the head carriage 16.

A cam shaft 28 has a prismatic shape, e.g. a square cross section and is rotatably provided at the other side of the head slide shaft 17 such that the lever 18 is disposed above the cam shaft 28. A gear 29 is coaxially secured to one end portion of the cam shaft 28. A tooth portion 31 is provided on one end face of a lever or arm 30 for displacing the recording head 15 so as to be brought into mesh with the gear 29. A wire 34 is connected between the lever 30 and a plunger 33 of an electromagnetic solenoid 32 for driving the lever 30.

Furthermore, a return spring 35 having an urging force larger than that of the coiled spring 24 is connected between the lever 30 and the solenoid 32. By retraction of the plunger 33 upon energization of the solenoid 32, the lever 30 is pivoted through the wire 34 in a direction of an arrow A of FIG. 3. On the other hand, during de-energization of the solenoid 32, the lever 30 is pivoted in a direction of an arrow B of FIG. 4 opposite to the direction of the arrow A by the urging force of the return spring 35 against the urging force of the coiled spring 24. Meanwhile, it can be so arranged that a pivotal range of the lever 30 is regulated by stoppers which are provided at opposite sides of the lever 30 and spaced apart by a predetermined distance.

Hereinbelow, operation of the head driving mechanism K1 is described. At the time of printing, the solenoid 32 is energized such that the plunger 33 is retracted as shown in FIG. 3. Hence, the lever 30 is pivoted in the direction of the arrow A through the wire 34, so that the cam shaft 28 is rotated in a direction of an arrow C through engagement between the gear 29 and the tooth portion 31 of the lever 30. Therefore, one of four flat side faces of the cam shaft 28 confront the lever 18 so as to be disengaged from the lever 18 as shown in FIG. 3. Accordingly, the head carriage 16 is rotated in a direction of an arrow D by the urging force of the coiled spring 24 and thus, the recording head 15 is depressed against the plate platen 26 through the recording paper 27. In this state, the head carriage 16 is intermittently displaced in the printing direction by the scanner carriage 20 such that printing is performed on the recording paper 27. At this time, since the coiled spring 24 is displaced together with the head carriage 16, the urging force of the coiled spring 24 for urging the head carriage 16 towards the platen 26, namely the pressing force applied from the recording head 15 to the platen 26 is at all times constant regardless of travel position of the recording head 15 relative to the head slide shaft 17. As a result, high-quality printing can be obtained by the constant printing pressure.

Thereafter, when the recording head 15 has reached a stroke end in the printing direction, the solenoid 32 is de-energized. Hence, as shown in FIG. 4, the lever 30 is pivoted in the direction of the arrow B by the urging force of the return spring 35, so that the gear 29 is rotated in a direction of an arrow E and thus, the cam shaft 28 stops in a state where one of four angular corners of the cam shaft 28 presses the lever 18 upwardly. Therefore, the head carriage 16 is rotated in a direction of an arrow F by the lever 18 against the urging force of the coiled spring 24 and thus, the recording head 15 is disengaged from the plate platen 26. In this disengagement state in which the recording head 15 is disengaged from the plate platen 26, the head carriage 16 is returned to a print start position. At this time, since the lever 18 is held in sliding contact with the angular corner of the cam shaft 28, the disengagement state of the recording head 15 is maintained. When the head carriage 16 has been returned to the print start position, the solenoid 32 is energized again such that printing is started.

Meanwhile, the facsimile apparatus is usually operated in a state where electric power is supplied to the facsimile apparatus at all times. Only when the facsimile apparatus has received image information, the head driving mechanism is actuated. Therefore, the facsimile apparatus in the ON state is usually held in a waiting state for reception. In this embodiment, since the solenoid 32 is held in a state of de-energization at the time of waiting for reception, electric power consumed by the head driving mechanism is saved and thus, operating cost of the facsimile apparatus is reduced.

Figure 6:
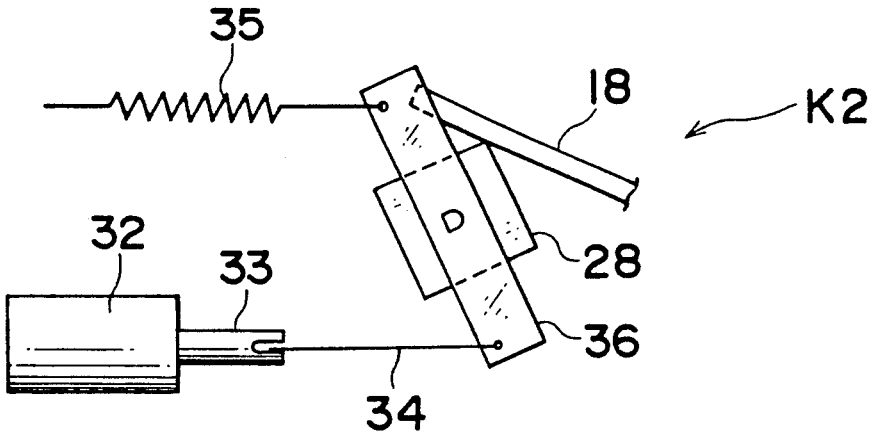
FIG. 6 is a fragmentary side elevational view of a head driving mechanism according to a second embodiment of the present invention.

FIG. 6 shows a head driving mechanism K2 according to a second embodiment of the present invention. In the head driving mechanism K1, a driving force of the solenoid 32 is transmitted to the cam shaft 28 through the lever 30 and the gear 29 such that the cam shaft 28 is rotated with a small torque. On the other hand, in the head driving mechanism K2, the lever 30 and the gear 29 of the head driving mechanism K1 are eliminated. In the head driving mechanism K2, an elongated platelike lever 36 for displacing the recording head 15 is secured to one end of the cam shaft 28, while the wire 34 and the return spring 35 are, respectively, attached to opposite ends of the lever 36. Since other constructions of the head driving mechanism K2 are the same as those of the head driving mechanism K1, description thereof is abbreviated for the sake of brevity. In the head driving mechanism K2, a torque necessary for rotating the cam shaft 28 becomes larger than that of the head driving mechanism K1. However, the head driving mechanism K2 is simplified, in structure, as compared with the head driving mechanism K1.

Figure 7:
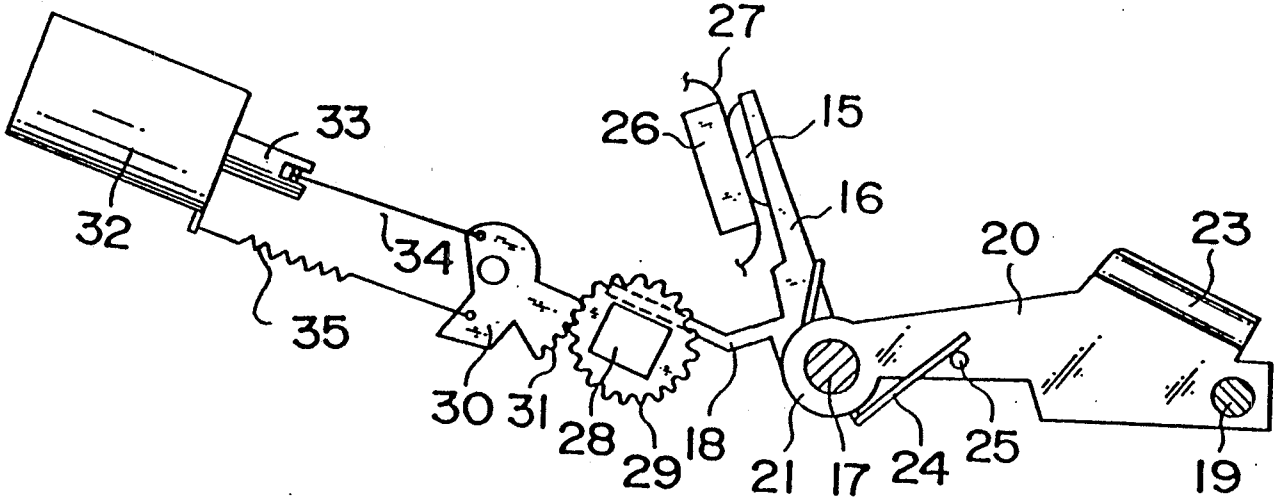
FIG. 7 is a side elevational view of a third embodiment of the present invention.

Meanwhile, the head driving mechanism of the present invention can be modified. For example, in the above described embodiments, the engagement operation of depressing the recording head against the platen is performed by energization of the solenoid 32, while the disengagement operation of disengaging the recording head from the platen is performed by the urging force of the return spring 35 at the time of de-energization of the solenoid 32. On the contrary, it can also be so arranged that the disengagement operation is performed by energization of the solenoid 32 and the engagement operation is performed by the urging force of the return spring 35 as seen in FIG. 7. Furthermore, the coiled spring 24 for urging the head carriage 16 to rotate relative to the head slide shaft 17 can be replaced by a leaf spring.

As will be seen from the foregoing description, in the head driving mechanism of the present invention, the cam shaft is rotated in opposite directions by energization of the electromagnetic solenoid and the urging force of the elastic member, respectively such that the recording head is depressed against and disengaged from the platen through the lever engaged with the cam shaft. Accordingly, in accordance with the present invention, since the rotational force is not required to be applied to the head carriage by the head slide shaft, it is only necessary that the head slide shaft allows the head carriage to slide and rotate thereon. Therefore, since the head slide shaft can be formed into a cylindrical shape and further, the cam shaft can also be formed into a simple shape such as a square cross section, these components can be machined at remarkably low cost, thereby resulting in considerable reduction of manufacturing cost of the head driving mechanism.

Meanwhile, in accordance with the present invention, since the head carriage is rotatably mounted on the head slide shaft, the urging member for applying the rotational force to the head carriage can be provided at the head carriage itself so as to be displaced together with the head carriage, so that printing pressure of the recording head can be made constant at all times regardless of position of the recording head upon displacement of the head carriage and thus, high-quality printing can be performed.

Especially, a case is assumed in which the head driving mechanism is applied to the facsimile apparatus and the head carriage is displaced by the scanner carriage. In this case, if the head slide shaft is formed with a projection so as to be rotated around its axis as in the prior art head driving mechanism referred to earlier, a complicated configuration for sliding the scanner carriage on the head slide shaft without engagement between the scanner carriage and the projection is required to be provided on the scanner carriage. However, in accordance with the present invention, since the cylindrical head slide shaft is employed, only the circular bore for slidably receiving the head slide shaft is required to be formed on the scanner carriage as in the head carriage.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A head driving mechanism for driving a recording head of a recording apparatus toward and away from a platen for engagement and disengagement therewith, said head driving mechanism comprising:

a generally cylindrical head slide shaft along which said recording head is displaced;

a head carriage having the recording head secured thereto and having a generally circular bore defined therein, said head slide shaft extending through the circular bore, said head carriage being slidably and rotatably fitted to said head slide shaft;

a rotatable cam shaft having a plurality of flat side faces and at least one angular corner, said cam shaft being mounted generally parallel to said head slide shaft;

a lever protruding from said head carriage, said lever engaging said cam shaft such that said head carriage is rotated upon rotation of said cam shaft;

an elastic member for urging said cam shaft to rotate in a first direction;

a solenoid which, upon energization thereof, rotates said cam shaft in a second direction opposite to the first direction; and interconnection means for operatively connecting said elastic member and said solenoid to said cam shaft, said elastic member and solenoid being mounted separate from said head carriage, and an urging force of said elastic member being applied indirectly to the head through the interconnection means, said interconnection means comprises an arm and an engageable member, said arm is operatively connected to the elastic member and the solenoid, the engageable member is mounted on the cam shaft, said arm and engageable member being interconnected such that movement of the arm rotates said engageable member to thereby rotate said cam shaft, the arm comprising a toothed lever and the engageable member comprising a gear, said toothed lever and gear being intermeshed to thereby be interconnected;

wherein one of the flat faces and the angular corner of said cam shaft selectively confront said lever of said head carriage by a driving force of said solenoid and the urging force of said elastic member applied during de-energization of said solenoid such that said head moves toward the platen for engagement and away from the platen for disengagement.

2. The head driving mechanism as claimed in claim 1, wherein the first direction is a direction for disengaging said recording head from said platen and the second direction is a direction for depressing said recording head against said platen such that the engagement operation and the disengagement operation are, respectively, performed by the driving force of said solenoid and the urging force of said elastic member.

3. The head driving mechanism as claimed in claim 1, wherein the first direction is a direction for depressing said recording head against said platen and the second direction is a direction for disengaging said recording head from said platen such that the engagement operation and the disengagement operation are, respectively, performed by the urging force of said elastic member and the driving force of said solenoid.

4. A head driving mechanism for driving a recording head of a recording apparatus toward and away from a platen for engagement and disengagement therewith, said head driving mechanism comprising:

a generally cylindrical head slide shaft along which said recording head is displaced;

a head carriage having the recording head secured thereto and having a generally circular bore defined therein, said head slide shaft extending through the circular bore, said head carriage being slidably and rotatably fitted to said head slide shaft;

a rotatable cam shaft having a protrusion and being positioned juxtaposed with said head slide shaft;

a lever projection from said carriage, said lever being brought into engagement with said cam shaft such that said head carriage is rotated upon rotation of said cam shaft;

an elastic member for urging said cam shaft to rotate in a first direction;

a solenoid which, upon energization thereof, rotates said cam shaft in a second direction opposite to the first direction;

interconnection means for operatively connecting said elastic member and said solenoid to said cam shaft, said elastic member and solenoid being mounted separate from said head carriage, and an urging force of said elastic member being applied indirectly to the head through the interconnection means, said interconnection means comprises an arm and an engageable member, said arm is operatively connected to the elastic member and the solenoid, the engageable member is mounted on the cam shaft, said arm and engageable member being interconnected such that movement of the arm rotates said engageable member to thereby rotate said cam shaft, the arm comprising a toothed lever and the engageable member comprising a gear, said toothed lever and gear being intermeshed to thereby be interconnected; and means for urging said head carriage to rotate in a direction for depressing said recording head against said platen, said means for urging being mounted on said head carriage and being displaceable therewith;

wherein during de-energization of said solenoid, said elastic member rotates said cam shaft in the first direction to bring said protrusion of said cam shaft into contact with said lever of said head carriage such that the head is disengaged from the platen, while during energization of said solenoid, said solenoid rotates said cam shaft via said interconnection means in the second direction to disengage said protrusion of the cam shaft from said lever of said head carriage such that the head is engaged with the platen.

5. The head driving mechanism as claimed in claim 4, wherein said means for urging comprises a coiled spring fitted around said head slide shaft.

* * * * *